United States Patent [19]

Cody et al.

[11] Patent Number: 4,992,159

[45] Date of Patent: Feb. 12, 1991

[54] UPGRADING WAXY DISTILLATES AND RAFFINATES BY THE PROCESS OF HYDROTREATING AND HYDROISOMERIZATION

[75] Inventors: Ian A. Cody, Clearwater; David L. Brown, Ontario, both of Canada

[73] Assignee: Exxon Research and Engineering Company, Florham Park, N.J.

[21] Appl. No.: 285,436

[22] Filed: Dec. 16, 1988

[51] Int. Cl.[5] ..... C10G 45/00; C07C 5/13

[52] U.S. Cl. ..... 208/89; 208/27; 208/28; 208/115; 585/734; 585/748; 585/749; 585/751; 585/752; 502/230

[58] Field of Search ..... 208/27, 28, 60, 84, 208/115; 585/734, 748, 749, 751, 752; 502/230

[56] References Cited

U.S. PATENT DOCUMENTS

| | | | |
|---|---|---|---|
| 2,463,527 | 12/1960 | Johnson et al. | 585/749 |
| 2,779,713 | 1/1957 | Cole et al. | 196/35 |
| 2,817,693 | 12/1957 | Koome et al. | 260/683.5 |
| 3,125,511 | 3/1964 | Tupman et al. | 208/264 |
| 3,158,662 | 11/1964 | Reichle et al. | 585/737 |
| 3,268,439 | 8/1966 | Tupman et al. | 208/112 |
| 3,308,052 | 3/1967 | Ireland et al. | 208/27 |
| 3,365,390 | 1/1968 | Egan et al. | 208/60 |
| 3,486,993 | 12/1969 | Egan et al. | 208/89 |
| 3,487,005 | 12/1969 | Egan et al. | 208/59 |
| 3,494,854 | 2/1970 | Gallagher et al. | 208/59 |
| 3,629,096 | 12/1971 | Divijak | 208/89 |
| 3,654,130 | 4/1972 | Voorhies, Jr. et al. | 208/18 |
| 3,663,422 | 5/1972 | Dun et al. | 208/28 |
| 3,684,684 | 8/1972 | Coleman et al. | 208/28 |
| 3,691,255 | 9/1972 | Takase et al. | 585/739 |
| 3,711,399 | 1/1973 | Estes et al. | 208/112 |
| 3,711,425 | 1/1973 | Suggitt et al. | 208/27 |
| 3,793,190 | 2/1974 | Nastast et al. | 28/18 |
| 3,794,580 | 2/1974 | Ladeur et al. | 208/110 |
| 3,830,723 | 8/1974 | Ladeur et al. | 208/108 |
| 3,852,189 | 12/1974 | Chen et al. | 208/18 |
| 3,864,425 | 2/1975 | Gardner | 585/749 |
| 3,915,843 | 10/1975 | Franck et al. | 208/112 |
| 4,186,078 | 1/1980 | Itoh et al. | 208/27 |
| 4,263,127 | 4/1981 | Rausch et al. | 208/58 |
| 4,518,485 | 5/1985 | La Pierre et al. | 208/89 |
| 4,647,368 | 3/1987 | McGuinessI et al. | 208/60 |
| 4,695,365 | 9/1987 | Ackelson et al. | 208/89 |
| 4,906,601 | 3/1990 | Cody et al. | 502/230 |
| 4,937,399 | 6/1990 | Wachter et al. | 585/749 |

FOREIGN PATENT DOCUMENTS

| | | | |
|---|---|---|---|
| 1177810 | 11/1984 | Canada | 252/2 C |
| 0225053 | 6/1987 | European Pat. Off. | 208/28 |
| 1225053 | 6/1987 | European Pat. Off. | 208/28 |
| 823010 | 11/1959 | United Kingdom . | |
| 951997 | 3/1964 | United Kingdom . | |
| 1065205 | 4/1967 | United Kingdom . | |
| 1381004 | 1/1975 | United Kingdom . | |
| 1440230 | 6/1976 | United Kingdom . | |

*Primary Examiner*—Helane Myers

*Attorney, Agent, or Firm*—Joseph J. Allocca

[57] ABSTRACT

Waxy distillates, or raffinates containing from as little as 10% wax but more typically about 30% wax or more are upgraded by a process comprising the steps of hydrotreating the waxy oil under conditions which convert less than 20% of the feed into products boiling lower than the feed to reduce the sulfur and nitrogen content of the oil followed by hydroisomerizing the hydrotreated waxy oil to reduce the wax content and increase the viscosity index. This oil having a waxy content of less than 30%, preferably less than 25%, can now be more easily dewaxed using conventional solvent dewaxing procedures. The advantage of the present process resides in the increased yield and/or stability of oil as compared to other upgrading, dewaxing processes which convert wax to light products. The isomerization catalyst is preferably a low fluorine content catalyst, more preferably a noble metal on 0.1 to less than 2 wt % fluorine on alumina catalyst, most preferably a noble Group VIII metal (e.g. Pt or Pd) on low fluorine content (less than 2 wt % fluorine) on small particle size alumina (less than 1/16 inch diameter) catalyst. The most preferred alumina support is a 1/20 inch trilobe.

14 Claims, No Drawings

UPGRADING WAXY DISTILLATES AND RAFFINATES BY THE PROCESS OF HYDROTREATING AND HYDROISOMERIZATION

PRESENT INVENTION

Waxy distillates, and raffinates are treated so as to achieve high yields of lube oil of increased viscosity index by selectively converting the wax into oil. The waxy oil feed is first hydrotreated under mild conditions to reduce the sulfur and nitrogen content but convert less than 20% of the feed into products boiling lower than the feed. This hydrotreated feed is then passed with hydrogen over a low fluorine content isomerization catalyst, preferably a catalyst having a particle size of less than 1/16 inch and a fluorine content of less than 2 wt %. Optionally, the isomerized distillate or raffinate can be treated in a subsequent third treatment unit employing a good hydrogenation catalyst if necessary, to produce a product of improved stability and color.

BACKGROUND OF THE INVENTION

Waxy distillates and raffinates containing appreciable quantities of wax e.g. 30% or more wax are not easily dewaxed using conventional dewaxing techniques such as solvent dewaxing. High wax contents leads to an overload in solvent handling and recovery systems. Neither are such waxy feeds amenable to catalytic dewaxing because catalytic dewaxing converts the wax to low boiling products (i.e. light gases or light liquids boiling in the fuels range) which inevitably results in a reduction of lube oil yield Typically, therefore, the waxy feeds containing 30% or more wax are converted to fuels by a process of fractionation under atmospheric and vacuum distillation condition with the vacuum distillate being sent to a catalytic cracker. For a waxy oil to be considered a viable lube feed the wax content usually should be about 30% or less, preferably below 25%.

Waxy oils have been subjected in the past to hydrotreating followed by isomerization.

U.S. Pat. No. 3,487,005 teaches the production of low pour point lubricating oils, without recourse to physical wax separation, from a high pour point, non-asphaltic waxy oil containing organic nitrogen and sulfur compounds and boiling mostly above 800° F. The process comprises first subjecting the waxy oil to catalytic hydrocracking-denitrification under specified conditions, to remove nitrogen and sulfur containing species from the oil and convert at least 20% of the feed into products boiling lower than the feed, and then subjecting at least the higher boiling components to catalytic isomerization-hydrocracking under specified conditions in the presence of an unsulfided naphtha reforming catalyst having no more than moderate acidity, and finally recovering from the isomerized product an 800° F.+bottoms fraction having a pour point at least 30° F. below the pour point of the waxy oil feed. In the isomerization-hydrocracking zone, at least 10% of the sweetened feed is converted to lower boiling materials.

The oil feeds used are preferably a straight run vacuum gas oil and deasphalted residual oils.

In the hydrocracking-denitrification zone, the conditions used are such that at least about 20% conversion of the feed to distillates lower boiling than the feed is achieved so as to obtain a high overall pour point reduction and to improve the viscosity index of the final product. Conditions in that first zone include temperature of 650° to 900° F., pressure of at least about 1000 psig hydrogen gas rate of at least 1000 SCF $H_2$/bbl and LHSV of 0.2 to 10. While some pour point reduction occurs in the first zone, it is not enough to significantly reduce the pour point of the highest boiling components unless conversion or treatment is carried far beyond what is needed to remove sulfur and nitrogen and thereby reduce product yield. The effluent from this first zone is passed to the isomerization zone. The isomerization zone is maintained at a temperature in the range of 700° to 900° F., pressure of 500 to 5000 psig, hydrogen gas rate of 2000 to 20,000 SCF $H_2$/bbl and LHSV of 0.2 to 10, conditions such that at least 10 wt % of the oil feed into zone 2 is hydrocracked to lower boiling distillates. The catalyst of zone 2 is a naphtha reforming catalyst, preferably a noble metal (i.e. Pt or Pd) on a porous refractory oxide such as alumina. The catalyst is of moderate acidity. This is achieved by promoting the alumina with a small amount of fluorine, 2 wt % or less. In an example, a catalyst containing 0.7 wt % Pt and 0.7 wt % fluorine on alumina is used to isomerize a hydrotreated straight-run gas oil distillate (Example 3).

U.S. Pat. No. 3,494,854 is directed at two stage catalytic hydrogen processing of a lube oil. A heavy lube oil distillate is converted into a refined mineral lube oil of reduced pour point. The raw waxy oil is contacted in a first zone with hydrogen in the presence of a sulfur-resistant HDS/HDN catalyst under hydrotreating conditions. The hydrotreated oil, after removal of low boiling components, is contacted in a second zone with hydrogen in the presence of a platinum group metal containing isomerization-hydrocracking catalyst containing a major amount of a calcium-exchanged crystalline alumino-silicate having pores of about 8 to 14 Å and a silica to alumina mole ratio of about 2 to 3:1 and a minor catalytic amount of about 0.1 to 5 wt % of a platinum group metal. See also G.B. No. 1,381,004, U.S. Pat. No. 3,629,096, and U.S. Pat. No. 4,518,485.

DESCRIPTION OF THE INVENTION

Waxy hydrocarbon oils such as waxy distillates and raffinates containing from as little as 10% wax but more typically about 30% or more wax are upgraded by a process comprising the steps of hydrotreating the waxy oil to produce a material of reduced sulfur and nitrogen content, isomerizing the hydrotreated material over a low fluorine content isomerization catalyst preferably a low fluorine content small particle size isomerization catalyst, one having a fluorine content of less than 2 and a particle size of less than 1/16 inch diameter and solvent dewaxing the resulting isomerate to produce an oil product of high viscosity index, low wax content, and low pour point in high yield.

Hydrotreating can be conducted under typical hydrotreating conditions to reduce sulfur and nitrogen contents to levels of 5 ppm or less nitrogen and 5 ppm or less sulfur. Any of the conventional hydrotreating catalysts can be employed, like Ni/Mo on alumina, Ni/W on alumina, Co/Mo on alumina, etc.; in other words, any of the Group VI-Group VIII on refractory metal oxide hydrotreating catalyst Commercial examples of such catalysts are identified as HDN-30 and KF-840.

The hydrotreated waxy oil is stripped to remove $NH_3$ and $H_2S$ and then isomerized over an isomerization catalyst. The isomerization catalysts are Group VIII metal on low fluorine content refractory metal oxide supports. Preferred catalysts contain Group VIII noble metals, e.g. platinum and palladium, typically 0.1 to 2.0 wt %. The catalysts preferably contain from 0.1 to up to but less than 2 wt % fluorine, preferably from 0.1 to 1.5 wt % fluorine. The refractory metal oxide support material is preferably an alumina containing material, more preferably predominantly (i.e. >50%) alumina, most preferably gamma or eta alumina. The support is preferably of small particle diameter of less than 1/16 inch and smaller. A preferred catalyst is noble Group VIII metal on 0.1 to up to but less than 2 wt % fluorine on alumina particles of diameter less than 1/16 inch. A more preferred catalyst is Pt or Pd on 0.1 to up to but less than 2 wt % fluorine (preferably 0.1 to 1.5 wt % fluorine) on alumina particles of diameter less than 1/16 inch (preferably 1/20 inch alumina trilobes). Preferably the catalyst is fluorided using an aqueous solution of $NH_4F$. This catalyst is the subject of copending application attorney docket number OP-3411, U.S. Ser. No. 285,437, now U.S. Pat. No. 4,906,601 filed even date herewith in the names of Cody and Brown.

Isomerization is conducted at a temperature between about 300° to 400° C., preferably 300° to 380° C., a pressure between about 500 to 5000 psig, preferably 1000 to 2000 psig, a hydrogen gas treat rate of 500 to 10,000 SCF $H_2$/bbl, preferably 2,000 to 5,000 SCF $H_2$/bbl, and a LHSV of 0.5 to 5 V/V/hr, preferably 1 to 2 V/V/hr.

The total isomerate is then dewaxed under standard solvent dewaxing conditions to a low pour point on the order of 0° C. and less, preferably −10° C. and less, most preferably −20° C. and less. In a preferred embodiment the total isomerate (before or after solvent dewaxing) is treated in a subsequent low temperature hydrogenation zone employing a good hydrogenation catalyst. This low temperature hydrogenation zone is run at a temperature in the range of about 170° to 270° C., preferably about 180° to 220° C., a pressure of about 300 to 1500 psi $H_2$, preferably about 500 to 1000 psi $H_2$, a hydrogen gas rate of about 500 to 10,000 SCF $H_2$/bbl, preferably 1000 to 5000 SCF $H_2$/bbl and a flow velocity of about 0.25 to 10 V/V/hr, preferably about 1 to 4 V/V/hr. This low temperature treatment is taught in copending application attorney docket number OP-3392, U.S. Pat. Ser. No. 283,659, now U.S. Pat. No. 4,937,399 which is a continuation-in-part of U.S. Pat. No. 135,149 filed Dec. 18, 1987 in the names of Cody, MacDonald, Eadie and Hamner. This third catalytic stage is practiced to further improve the stability and the color of the product. The catalyst used in this stage can be any good hydrogenation catalyst, preferably a noble Group VIII metal on fluorided alumina, fluorine level ranging from zero to 10 wt %, more preferably a noble Group VIII metal on low fluorine (less than 2 wt % F) on small particle size alumina (less than 1/16 inch diameter) catalyst. While this third catalytic stage will help improve stability and color, it will not be completely effective if excessively severe conditions are used in either of the first 2 stages. It is preferred that temperatures in either of the first two stages do not exceed 380° C.

The dewaxing solvent used can include the $C_3$–$C_6$ ketones such as methyl ethyl ketone, methyl isobutyl ketone, mixtures of MEK and MIBK, aromatic hydrocarbons like toluene, mixtures of ketones and aromatics like MEK/toluene, ethers such as methyl terbutyl ethers and mixtures of same with ketones or aromatics. Similarly, liquefied, normally gaseous hydrocarbons like propane, propylene, butane, butylene, and combinations thereof.

The waxy oils treated in the process contain as little as 10% but more typically about 30% or more but less than 70% wax. The oils are distillates boiling in the lube oil boiling range or waxy raffinates from which aromatic hydrocarbons have been solvent extracted. Typical feeds may be waxy distillates or raffinates boiling in the range 300° to 700° C. High wax content oils are usually not considered good lube oil feedstocks because the high wax content overloads wax recovery in the solvent dewaxing process. Similarly, high wax content means that catalytic dewaxing converts a substantial fraction of the feed to gaseous or light liquid product with a concomitant loss in overall lube oil yield.

EXAMPLES

Catalyst 1 contains 0.4 wt % F on a reforming grade catalyst originally containing 1% $Cl^-$ and 0.3% Pt on 1/16 inch $Al_2O_3$. The comparative Catalyst 2 comprises 3% F on the same $Pt/Al_2O_3$ base. In both catalysts, fluoride was deposited using $NH_4F$ aqueous solution using the incipient wetness technique, described below.

The feed to these catalysts was a South Louisiana hydrotreated raffinate. The properties of the original waxy raffinate prior to hydrotreating were:

| | | |
|---|---|---|
| Refractive Index | | 1.4667 |
| Density at 15.C | | 0.8898 |
| Total Nitrogen, ppm | | 140 |
| Sulfur (X-ray), wt % | | 0.33 |
| GCD °C., | ibp/1 | 332/359 |
| | 5/10 | 426/451 |
| | 20/30 | 476/492 |
| | 40/50 | 504/516 |
| | 60/70 | 527/539 |
| | 80/90 | 553/570 |
| | 95/fbp | 585/614 |

To establish the inherent properties of the oil component of the raffinate, dewaxing was performed on a portion of the feed using 100% MIBK at 3:1 solvent:feed ratio and a filter temperature of −13° C.

The dewaxed oil inspections on the raffinate were:

| | |
|---|---|
| Recovered Wax, wt % | 10.4 |
| Viscosity @ 40° C., cSt | 165.64 |
| Viscosity @ 100° C., cSt | 14.91 |
| Viscosity Index | 88 |
| Pour Point, °C. | −9 |
| HPLC Separation | |
| Saturates, wt % | 75.6 |
| Aromatics, wt % | 23 4 |
| Recovery, wt % | 99 |

The waxy raffinate itself contains a substantial quantity of saturated rings (naphthenes) which are poor VI molecules. However, VI can be increased somewhat with subsequent hydrotreating which converts a portion of the naphthenes into iso-paraffins. Hydrotreating also serves to lower sulfur and nitrogen concentrations.

Hydrotreating of the above waxy raffinate was performed using a $NiW/Al_2O_3$ catalyst containing about 6% fluorine following in-situ fluoriding using orthofluoro toluene. Properties of this catalyst and the method of activating are discussed below.

The hydrotreating catalyst was run at the following conditions:

| | |
|---|---|
| Temperature, °C. | 353 |
| Feed Rate, v/v/h | 0.5 |
| Gas Rate, SCF/B | 3000 |
| Pressure, psi $H_2$ | 600 |

These conditions are sufficient to reduce both S and N in the waxy product to <1 ppm each and mild enough so that less than 20% of the feed is converted into products boiling below the boiling point of the feed.

Again, to establish the properties of the oily component of this hydrotreated waxy raffinate, the total liquid product was topped to 370° C. on a Model C Hivac (removing 3.9 wt % 370° C.[31]), then dewaxing was performed on a 370° C.+portion of the feed using 20/80 MEK/MIBK at 4:1 solvent feed ratio and a filter temperature of −13° C.

The dewaxed oil inspections on the 370° C.+topped hydrotreated raffinate were:

| | |
|---|---|
| Recovered Wax, wt % | 13.0 |
| Viscosity @ 40° C., cSt | 116.16 |
| Viscosity @ 100° C., cSt | 12.28 |
| Viscosity Inex | 95.5 |
| Pour Point, °C. | −12 |

Notice that the wax content of this product is relatively higher than in the original raffinate, i.e. conventional raffinate hydrotreating does not convert wax selectively.

The raffinate isomerization step was performed using the waxy total liquid product from the raffinate hydrotreating step as feed. The products from this part of the process were dewaxed using 20/80 MEK/MIBK at 4:1 solvent:feed ratio and a filter temperature of —13° C. The several products derived from treatments and the various conditions used over Catalyst 1 (low fluorine) and Catalyst 2 (high fluorine) are shown in Table 1.

Both Catalysts 1 and 2 convert the wax component of the hydrotreated raffinate more selectively than the other molecules in the feed since in all cases the residual wax in the 370° C.+product falls below the feed value of 13.0 wt %. In this respect, Catalysts 1 and 2 behave differently from the catalyst used in the hydrotreating step. Catalyst 1 though, is much more effective at wax conversion than catalyst 2 and is also better at increasing VI.

Taking the 370° C.+dewaxed raffinate feed as representing 100% of recovered product, Catalyst 1 preserves high relative yields (80 to 90%) while increasing the VI by as much as 10 to I7 points.

It is apparent from Table 1 that Catalyst 1 must be doing more than just isomerizing wax in order for the VI to be as high as 113. For example, even if all of the original wax in the hydrotreated raffinate feed were to be isomerized directly into 145 VI isomerate, this would still only raise the VI to just above 100 if no other chemistry were taking place. Clearly Catalyst 1 is also an excellent catalyst for ring opening naphthenes.

These results demonstrate that low fluoride level $Al_2O_3$-based catalysts are excellent "raffinate isomerization" catalysts even on low wax content feeds. However, even higher VI's can be obtained from raffinates or distillates derived from the waxier crudes.

Preferred catalysts for raffinate isomerization, therefore, are $Al_2O_3$-based catalysts comprising Group VIII metals or Group VIII/Group VI combinations and containing less than 2% F, preferably 0.2 to 1.5 wt % F. The preferred fluoriding media is aqueous $NH_4F$.

EXPERIMENTAL (a) Test Units

The $NH_4F$-treated catalysts were tested in two different units in an upflow mode with 100 cc catalyst charges. These units are similar in design and operation and have previously given identical results for isomerization of a given feed by a standard catalyst. Both units operated on an eight hour per day basis.

(b) Activation Procedure

Each catalyst was activated in the same fashion:

1. Heat from room temperature to 100° C. in $H_2$ at 50 psi, 3 cubic ft/hr over a two hour period.
2. Hold at 100° C. for one hour.
3. Raise temperature to 350° C. over a two hour period.
4. Hold at 350° C. for one hour.
5. Cool to below 300° C., adjust pressure to 1000 psi (6.9 MPa) and gas rate to 5000 SCF/B (888 API $m^3/m$), and cut in feed at 0.9 v/v/hr (where LHSV is based on feed at room temperature).

(c) Oil Yield Determination

Oil yields on 370° C.+fractions (obtained by distillation on a Model C Hivac) were determined by the modified ASTM D3235 procedure, incorporating 100% MIBK as solvent rather than 50:50 MEK/toluene and by filtering at −35° C.

(d) Preparation of $NH_4F$ Treated Catalysts 100 grams of a commercial reforming grade Pt on $\gamma Al_2O_3$ 1/16" extrudates catalyst containing 0.3 Pt and 1% $Cl^-$ was treated with 55 ml of aqueous solutions containing $NH_4F$ by drop-wise addition and stirring. This volume of solution was sufficient to just wet the entire 100 gm of catalyst.

The amount of hygroscopic $NH_4F$ used to make up the 55 ml solution was:

| | |
|---|---|
| Catalyst 1 | 1.05 gms (0.4% F on catalyst) |
| Catalyst 2 | 8.4 gms (3% F on catalyst) |

The wetted extrudates were left for one hour at room temperature, dried at 120° C. for 16 hours, then calcined in an air flow at the following conditions: hold at 150° C. for one hour; raise temperature by 50° C. every 15 minutes to 400° C.; then hold at 400° C. for one hour.

TABLE 1

Low Fluoride Catalyst Produces high VI Product in High Yields

| Reaction Conditions | Hydrotreated Raffinate Feed | Catalyst 1 (0.4% F) | | | | Catalyst 2 (3.0% F) | | | |
|---|---|---|---|---|---|---|---|---|---|
| Temperature, °C. | — | 361 | 364 | 372 | 380 | 303 | 286 | 276 | 282 |
| Feed rate, v/v/h | — | 0.9 | 0.9 | 0.9 | 0.9 | 0.9 | 0.9 | 0.9 | 0.9 |
| Gas rate, SCF/b | — | 5000 | 5000 | 5000 | 5000 | 5000 | 5000 | 5000 | 5000 |
| Pressure, psi $H_2$ | — | 1000 | 1000 | 1000 | 1000 | 1000 | 1000 | 1000 | 1000 |

TABLE 1-continued

Low Fluoride Catalyst Produces high VI Product in High Yields

| Reaction Conditions | Hydrotreated Raffinate Feed | Catalyst 1 (0.4% F) | | | | Catalyst 2 (3.0% F) | | | |
|---|---|---|---|---|---|---|---|---|---|
| Time on stream[1], hrs | — | 169 to 170.5 | 176 to 177.5 | 182 to 183.5 | 185 to 190 | 71.5 to 74 | 79 to 81 | 87 to 89 | 93.7 to 95.5 |
| Product Inspections | | | | | | | | | |
| Conversion to 370° C.−, wt % | 3.9 | 15.9 | 20.0 | 24.9 | 40.0 | 53.1 | 26.9 | 16.4 | 16.4 |
| Dry wax in 370° C.+, wt % (on feed) | 13.0 | 9.7 | 8.9 | 7.5 | 6.4 | 9.6 | 11.0 | 12.4 | 12.0 |
| Dewaxed Oil | | | | | | | | | |
| 370° C.+ yield on feed, wt % | 83.6 | 75.9 | 72.9 | 69.4 | 56.1 | 42.4 | 65.1 | 73.2 | 73.6 |
| Relative 370° C.+ oil yield, % | 100 | 90.8 | 87.2 | 83.0 | 67.1 | 50.7 | 77.8 | 87.6 | 88.0 |
| Viscosity @ 40° C., cSt | 116.16 | 72.68 | 64.45 | 56.39 | 47.12 | 54.77 | 85.76 | 96.08 | 93.2 |
| Viscosity @ 100° C., cSt | 12.28 | 9.42 | 8.79 | 8.14 | 7.30 | 7.75 | 10.12 | 10.85 | 10.69 |
| Viscosity Index | 95.5 | 106.5 | 109.7 | 113.0 | 116.1 | 105.7 | 98 | 96 | 97 |
| Pour Point, °C. | −12 | −12 | −12 | −12 | −15 | −12 | −12 | −12 | −12 |
| ASTM Color D150 | 1.5 | 1.5 | 1.5 | 1.5 | 2.0 | 0.0 | 0.0 | 0.0 | 0.0 |

[1]Both Catalysts 1 and 2 had been on stream on hydrotreated 600N slack wax for 137 hours and 52 hours, respectively, prior to introduction of hydrotreated raffinate.

EXAMPLE 2

This example shows the criticality of practicing hydrotreating and isomerization in sequence rather than by hydrotreating alone. The two stage process incorporates a conventional hydrotreating catalyst (KF-840) in the first stage and a 0.3 Pt on 0.4% F/$Al_2O_3$ catalyst in the second stage. The one stage process used a Ni-W on $Al_2O_3$ catalyst that containing about 6% fluorine following in-situ fluoriding using ortho fluoro toluene, on unhydrotreated distillate.

The waxy distillate contained about 42% wax, had a VI of about 85 and a viscosity @ 100° C. of 6.5.

The results are presented in Table 2.

TABLE 2

WAXY DISTILLATE UPGRADED BY LOW FLUORIDE CATALYST
Feed: Waxy Broadcut Distillate (370 to 540° C.)

| Catalyst | Feed | NiW/F-$Al_2O_3$ (feed not hydrotreated) | Pt/F $Al_2O_3$ 0.4% F 1/16" Extrudates (following hydrotreating using KF 840) |
|---|---|---|---|
| Reactor Temp. °C. | | 385 | 390 |
| LHSV, v/v/h | | 0.9 | 1.0 |
| Pressure, psi $H_2$ | | 1230 | 1000 |
| Gas Rate, SCF/B | | 5000 | 5000 |
| Net Conversion to 370° C.− | — | 20.0 | 11.2 |
| VI | 85 | 120 | 120 |
| Viscosity, 100° C., cSt | 6.5 | 4.7 | 4.6 |
| % Wax in 370° C.+ | 42 | 43 | 38 |
| DWO Yield on Distillate, wt % | 100 | 45.6 | 55.0 |

It is seen that the two-stage process can result in higher yields of a high VI product as compared to a one stage process. From all the above, it is seen that low fluorine catalysts are selective for wax conversion while high fluorine catalysts (e.g. ~3%) are not. Furthermore, low fluorine catalysts convert less material to 370° C.− product in producing oils of essentially the same VI and viscosity.

EXAMPLE 3

Platinum on low fluoride content small particle size alumina catalysts were compared with platinum on low fluoride content larger (1/16 inch diameter) particle size alumina catalyst and platinum on high fluoride content small particle size alumina catalyst for wax isomerization. It was discovered that the low fluoride content small particle (1/20 inch diameter) catalysts are more selective for wax isomerization than either the low fluoride/large particle or high fluoride/small particle catalyst.

Catalysts A and B are low fluoride small particle catalysts; Catalyst C is a low fluoride, larger particle size catalyst; Catalysts D and E are high fluorine, larger particle and high fluorine small particle size catalyst respectively These catalysts were evaluated for the isomerization of hydrotreated slack wax obtained from the dewaxing of 600N oil. Hydrotreating was accomplished using Ni/Mo alumina catalyst (KF-840) to a sulfur level of less than 1 ppm and a nitrogen level of less than 1 ppm. Wax isomerization was performed at the conditions recited in Table 3 which also reports the isomerization results.

It is seen that Catalysts A and B produced substantially higher yields of oil as compared to the product yields resulting from the use of Catalysts C, D and E.

TABLE 3

YIELD ADVANTAGES AT LOW FLUORIDE CONTENT AND SMALL PARTICLE SIZE
FEED: HYDROTREATED 600N SLACK WAX
(20% OIL IN WAX)

| Composition | A | B | C | D | E |
|---|---|---|---|---|---|
| F, wt % | 0.93 | 0.5 | 0.42 | 7.0 | 6.7 |
| Pt, wt % | 0.3 | 0.3 | 0.3 | 0.58 | 0.62 |
| Particle Diameter (inch) | 1/20 | 1/20 | 1/16 | 1/16 | 1/20 |
| Shape[1] | T | T | E | E | T |
| Reaction Temp, °C.[2] | 355 | 370 | 380 | 320 | 330 |
| Pressure, psi $H_2$ | 1000 | 1000 | 1000 | 1000 | 1000 |
| LHSV, v/v/hr | 1.0 | 1.0 | 1.0 | 1.0 | 1.0 |
| Gas Rate, SCF/B | 2500 | 2500 | 2500 | 2500 | 2500 |

TABLE 3-continued

YIELD ADVANTAGES AT LOW FLUORIDE CONTENT AND SMALL PARTICLE SIZE FEED: HYDROTREATED 600N SLACK WAX (20% OIL IN WAX)

| Composition | A | B | C | D | E |
|---|---|---|---|---|---|
| 370° C.+ Yield on feed, wt %(3) | 60 | 67 | 55 | 50 | 50 |

(1)E = extrudate, T = trilobe
(2)Temperature required for 70% conversion of wax in feed after 250 hr on stream.
(3)Maximum once-through yield of 370° C.+ oil based on oil content determination using 100% MIBK.

EXAMPLE 4

This example illustrates how a 2-staged process may be used to improve product color versus the 1-staged process. The poor stability and poor color of hydrotreated products versus solvent processed products is difficult to avoid in a one stage process because the conditions required for desirable ring opening are severe enough to create unstable and/or colored species. We have found that even the best conventional catalysts, such as Ni-W/F $Al_2O_3$ require temperatures of 370° C. or higher to achieve significant VI improvement of raffinates or distillates. On the other hand, the 2 stage process is more flexible, and lower temperatures can be used to achieve the same VI improvement. For example, the first stage catalyst (R!) does not have to operate as a ring opening catalyst, except as is needed to lower nitrogen to ~1 ppm. Also the second stage catalyst (R2) may operate at low temperatures if the right catalyst composition is used. In Example 2, the second stage operated at relatively high temperatures but, as taught in the preceding Example 3, activity can be traded for selectivity. Reference to Table 4 shows that by adjustment of the fluoride content (i.e. low fluorine content) and the use of smaller sized catalyst particles, a desirable product can be made at moderate conditions from a 700N waxy raffinate.

Products of about the same VI and yield were made by both a one-stage treatment and by 2-stage treatment. The 2-staged product was lightly colored, whereas the one-staged product was bright yellow.

Thus 2 staging produces a significant advantage for lube products which are to be formulated for industrial oils use or to be sold as base oils.

TABLE 4

COMBINATION PROCESS ALLOWS LOW TEMPERATURES STABLE PRODUCTS MAY BE MADE
Feed: 700N Waxy Raffinate

| | | | 2-Stage Process | |
|---|---|---|---|---|
| Catalysts | Feed | 1-State Process Ni-W/F-$Al_2O_3$ | R1 Ni-W/F-$Al_2O_3$ | R2 Pt F/$Al_2O_3$ (1% F)/1/20" trilobe |
| Process Conditions | | | | |
| Temperature, °C. | — | 375 | 363 | 340 |
| Pressure, psi $H_2$ | — | 1230 | 1230 | 1000 |
| LHSV, v/v/hr | — | 0.9 | 0.9 | 0.9 |
| Dewaxed Oil | | | | |
| Product Properties (370° C.+) | | | | |
| VI | 89 | 114.6 | 104.3 | 112 |
| Viscosity, @ 100° C., cSt | 14.8 | 8.7 | 10.7 | 8.6 |
| Yield on feed, wt % | 100 | 84.9 | 90.4 | 82.8 |
| Wax Content in 370° C.+ | 14.6 | 18.6 | 17.3 | 11.9 |
| Color | | Bright Yellow | | light color |

What is claimed is:

1. A method for upgrading waxy distillates and raffinates so as to achieve increased yields of oil of increased viscosity index by the process comprising the steps of:
   (a) hydrotreating the waxy distillate or raffinate under conditions so as to reduce the sulfur and nitrogen content thereof;
   (b) isomerizing the hydrotreated feed from step (a), over a low total fluorine content small particle size isomerization catalyst having a fluorine content of less than 2 wt % and a particle size of less than 1/16 inch diameter, in the presence of hydrogen;
   (c) dewaxing the isomerate to a pour point of 0° C. and less.

2. The method of claim 1 wherein the waxy distillate or raffinate feed contains as little as 10% wax.

3. The method of claim 1 wherein the waxy distillate or raffinate feed boils in the range of 300 to 700° C. and contains about 30% or more but less than 70% wax.

4. The method of claim 1 wherein the isomerization step is conducted at a temperature between about 300° to 400° C., a pressure between about 500 to 5000 psig, a hydrogen gas treat rate of 500 to 10,000 SCF $H_2$/bbl, and a LHSV (liquid hourly space velocity) of 0.5 to 5 V/V/hr.

5. The method of claim 1 further comprising the step of treating the isomerate in a low temperature hydrogenation zone employing a hydrogenation catalyst before or after the dewaxing step.

6. The method of claim 1, 2, 3, 4, 5 or 14 wherein the isomerization catalyst comprises a Group VIII metal on a 0.1 to up to but less than 2 wt % fluorine content refractory metal oxide.

7. The method of claim 1, 2, 3, 4, 5 or 14 wherein the isomerization catalyst comprises a Group VIII noble metal on a 0.1 to up to but less than 2 wt % fluorine content on alumina containing refractory metal oxide support.

8. The method of claim 6 wherein the isomerization catalyst comprises a Group VII metal on a 0.1 to 1.5 wt % fluorine content refractory metal oxide support.

9. The method of claim 7 wherein the isomerization catalyst comprises a Group VIII noble metal on a 0.1 to 1.5 wt % fluorine content alumina support.

10. The method of claim 9 wherein the isomerization catalyst comprises 1/20 inch alumina trilobes.

11. The method of claim 8 wherein the order of practicing the dewaxing step and the low temperature hydrogenation step is switched.

12. The method of claim 9 wherein the order of practicing the dewaxing step and the low temperature hydrogenation step is switched.

13. The method of claim 10 wherein the order of practicing the dewaxing step and the low temperature hydrogenation step is switched.

14. The method of claim 1 wherein the hydrotreating step is performed under conditions which convert less than 20% of the waxy distillates or raffinate feed into products boiling lower than the feed.

* * * * *